United States Patent [19]

Trutna

[11] Patent Number: 4,648,549

[45] Date of Patent: Mar. 10, 1987

[54] SELF-LOCKING CONTAINER

[75] Inventor: Maynard A. Trutna, Orange Park, Fla.

[73] Assignee: Jefferson Smurfit Corporation, Alton, Ill.

[21] Appl. No.: 840,538

[22] Filed: Mar. 17, 1986

Related U.S. Application Data

[63] Continuation of Ser. No. 723,791, Apr. 16, 1985, abandoned.

[51] Int. Cl.[4] ..... B65D 5/24

[52] U.S. Cl. ..... 229/143; 229/151; 229/177

[58] Field of Search ..... 229/141, 143, 151, 154, 229/177

[56] References Cited

U.S. PATENT DOCUMENTS

| | | | |
|---|---|---|---|
| 676,015 | 6/1901 | Webb | 229/151 |
| 1,920,184 | 8/1933 | Brackett | 229/31 R |
| 2,058,818 | 10/1936 | Ottinger | 229/151 |
| 2,073,272 | 3/1937 | Wellman | 229/31 R |
| 2,295,508 | 9/1942 | Altheimer | 229/31 R |
| 2,373,730 | 4/1945 | Williamson et al. | 229/31 FS |
| 2,443,531 | 6/1948 | Berch | 229/151 |
| 3,606,078 | 9/1971 | Phillips, Jr. | 229/31 FS |
| 4,082,215 | 4/1978 | Eichenauer | 229/33 |
| 4,119,265 | 10/1978 | Dlugopolski | 229/31 FS |
| 4,184,429 | 4/1979 | Burr et al. | 229/31 FS |
| 4,208,007 | 6/1980 | Bamburg et al. | 229/31 R |
| 4,236,740 | 12/1980 | Sorenson et al. | 229/31 FS |
| 4,391,405 | 7/1983 | Drinon | 229/31 R |

FOREIGN PATENT DOCUMENTS

| | | | |
|---|---|---|---|
| 1477547 | 3/1967 | France | 229/31 R |
| 2407862 | 7/1979 | France | 229/31 R |
| 2453083 | 12/1980 | France | 229/31 R |
| 934367 | 8/1963 | United Kingdom | 229/31 FS |

*Primary Examiner*—William Price
*Assistant Examiner*—Gary E. Elkins
*Attorney, Agent, or Firm*—Paul M. Denk

[57] ABSTRACT

A self locking container formed of a series of side, bottom, and end walls, all integrally folded together, and incorporating one or a pair of covers, the container generally formed of a unitary blank of paperboard or corrugated material, that may be folded into its usable configuration. Intermediate each end wall and side wall are bellows flaps, that fold contiguously into adjacency against the outer surface of each of their respective end walls, during folding of the carton, and a connecting flap formed along the upper edge of each end wall folds overlying the upper edges of the disposed proximate bellows flaps, to interlock them into position, for forming the body or lower portion of the container. One or a pair of cover parts foldably connect with the upper edge of each side wall, and when folded over into closure, dispose end flaps, at each end, which can be folded downwardly, against the proximate bellows flaps, and then tucked under the same, to provide for a fully interlocked connection between the container's cover, and its formed body portion, useful for the packaging of bulk material, such as food products, meats, or the like.

6 Claims, 8 Drawing Figures

SELF-LOCKING CONTAINER

This is a continuation of the application having Ser. No. 723,791, filed on Apr. 16, 1985 now abandoned.

BACKGROUND OF THE INVENTION

A multitude of containers formed of paperboard, corrugated board, and the like, have been devised and designed that incorporate various styles of interlocking flaps and walls in order to assure the more permanent and lasting closure of the carton body into the container form, as when it is ready for application and usage. Usually, though, these types of containers include a body portion for the said container and which is formed from an integral and unitary blank, with said body portion being formed from a folding of the blank into that configuration. Then, the lid, which is usually separate, is independently folded into a covering means, and some times incorporating downwardly extending flanges, in order to provide for its application upon and locked into closure with the previously formed container body. Where the container body and cover are formed from an integral blank, usually the downwardly extending flanges around the perimeter of the cover is all the interconnection designed for that type of a container to assure its maintenance in closure, but frequently any slight jarring or impact experienced by the container during its handling, particularly where it may be laden with bulk product, such as in the category food products like vegetables, fruits, meats, or the like, can readily cause an untimely and undesired opening of the cover or lid during such handling. Cartons of the foregoing type can generally be found in the U.S. Pat. Nos. 3,196,021, 4,017,017, 2,901,159, 2,597,848, 3,883,067, 3,547,337, 3,307,769, 2,809,775, 2,758,781, and 3,410,475.

It is the princpal object of this invention to provide an integrated container wherein the body portion of the carton is formed from an integral blank, incorporating means that cooperates between various container walls to provide for its interlocking into the container body form, and further incorporating cover means for further cooperation with the interlocking means to assure a rigid connection and maintenance into closure of the entire container as during application and shipment.

Another object of this invention is to provide the application of bellows flaps intermediate various walls of the formed container body to assure not only a proper interlocking of the said walls into closure, but likewise, in that manner, provide a fluid type seal that prevents leakage from any of the food product or related materials packaged within the container during its usage.

A further object of this invention is to provide an interlocking engagement between the cover for a container and which secures with the means providing for connection of the container body into its integral form, in order to provide a totally integrated self locking container that can be readily folded from the blank form, into its usable configuration, locked into closed position, but immediately reopened as desired.

Still another object of this invention is to provide a self locking container wherein the means providing for engagement of the container body and cover into its closure configuration has further utility for providing the carrying means to facilitate the carting of the product ladened container during its usage.

Still another object of this invention is to provide a particularly styled self locking container which can be coated upon its inner or interior surfaces with either a resin, wax, parafin, or the like, in order to function as a leak proof container.

Another object of this invention is to eliminate the usage of tapes and the like to seal or lock containers, and the application of plastic bags to render the containers moisture tight.

These and other objects may become more apparent to those skilled in the art upon reviewing the subject matter of this invention, as summarized hereinafter, and as described in its preferred form in view of its drawings.

SUMMARY OF THE INVENTION

This invention contemplates the formation of a totally integrated container, of the self locking type, which may additional include the attachment of a cover or lid means to the body structure of the container when folded into its usable configuration, from the blank form. In the preferred embodiment, the cover is integrally attached with the body portion for the container. But, it is likewise conceivable that the cover for the container may be formed separately, but yet retain the unique interlocking feature that provides for its connection with the body of the container during its application.

Essentially, the self locking container of this invention is formed from the blank form, incorporating a series of walls that integrally connect together, such as a pair of end walls, a pair of side walls, and a bottom wall, which foldably connected together, additionally through bellows flaps, for securement into the container body. Intermediate each end wall and an adjacent side wall are the said pair of bellows flaps, which likewise foldably connect together, such that when the side and end walls are folded into their perpendicular arrangement, as with respect to the bottom wall, the bellows flaps likewise fold upon each other, and then may be subsequently folded into contiguity against the outer surface of the end wall, and in this position, provide a totally integrated structure for the container body, which may be secured into its connected form for functioning in the capacity for holding various products in the category of food products, meats, and the like. A number of advantages can be attained from this particular feature, through the application of integrally related bellows flaps in the formation of the container body, and which include the fact that the container body is a totally sealed container bottom, leak proof, and through the application of a resin, parafin, wax, or the like, to the inner surface of the container body, or impregnated therein, forms a sealed container that not only prevents the aforesaid type of leakage, but likewise, can preserve the freshness of any product stored therein. In addition, a further advantage through the application of bellows type flaps in the formation of the container body is that these flaps, when folded over upon themselves, and disposed contiguously against the outer surface of an end wall, provide the means for interengagement with any cover or lid secured onto the container body, as when it is formed into closure. The cover may include interlocking means that engage with these bellows flaps, or particular of their edges, so as to interlock the components together to assure their retention into connection, to prevent their untimely disengagement, or a loss of the cover, as may frequently occur with prior art cartons that provide only temporary or independent engagement of a cover upon the carton body, simply through the application of friction retention flaps around the perimeter of the cover, or the like. A further advantage of this particular invention, in the manner of its fabrication, is that the bellows flaps when folded over into overlying relationship, in the container body, dispose an angulated and broadened edge that can conveniently be grasped by the worker as he manually picks up and conveys the container, thereby providing a built in handle means that eliminates the necessity of fabricating hand holes into the container body, thereby exposing the interior of the carton, such as is frequently done in the prior art.

While this particular invention has been defined as specifically arranging the bellows type flaps exteriorly of each end wall of the fabricated container body, and while this is the preferred embodiment, it is possible that these bellows flaps could be folded inwardly of the container, during its formation, and be arranged contiguously against the interior surface of the disposed end walls, when the container body is fabricated into a usable configuration.

To assure that the container body when folded retains its desired configuration, each end wall includes an upper disposed connecting flap, which may be folded over into overlying relationship upon the proximate and arranged bellows flaps, for interlocking these components together, and for assuring the retention of the container body into its usable form, once assembled. In addition, the connecting flap may be secured with its proximate end wall through one or more tabs, and likewise, the upper disposed edges of the arranged bellows when folded into contiguity against an end wall, may dispose upper arranged cutout portions, that are disposed for alignment with the connecting flap end wall tabs, so that the tabs of the connecting flaps may snugly fit within the said cutout portions to assure interlocking of these components together, and a more permanent retention of the container body into its usable configuration.

As previously explained, the cover for the container body may be independently fabricated, and folded into interlocking engagement with the container body, when formed, but in the preferred embodiment, the cover may be constructed of one or a pair of closure flaps, being secured along the upper edge of one or both of the side walls, respectively, so that in the blank form, the entire self locking container, including all of its container body, and cover, may be formed from a unitary blank. In the preferred embodiment, the cover is formed of two parts, approximating one-half the width of the container, with each cover part being foldably connected upon and into engagement with an upper edge of a respective side wall. Each cover part, likewise, contains at each of its ends an end flap, and these end flaps are designed for folding downwardly into overlying relationship with the proximate bellows flaps, with each end flap including an additional flap that is designed for tucking under the proximate and angularly disposed edge of the bellows flaps for providing that interlocking engagement and connection between the cover and the container body, into its usable configuration, particularly after the container has been ladened with bulk material, as readied for either shipment, storage, or generally marketing to the trade. In addition, one of the cover parts may be of slightly greater width than the other, so as to overlap the other cover part when the cover is folded into closure, so as to assure as reasonable a sealed closure of the container when applied.

DESCRIPTION OF THE PREFERRED EMBODIMENT

Figure 1:
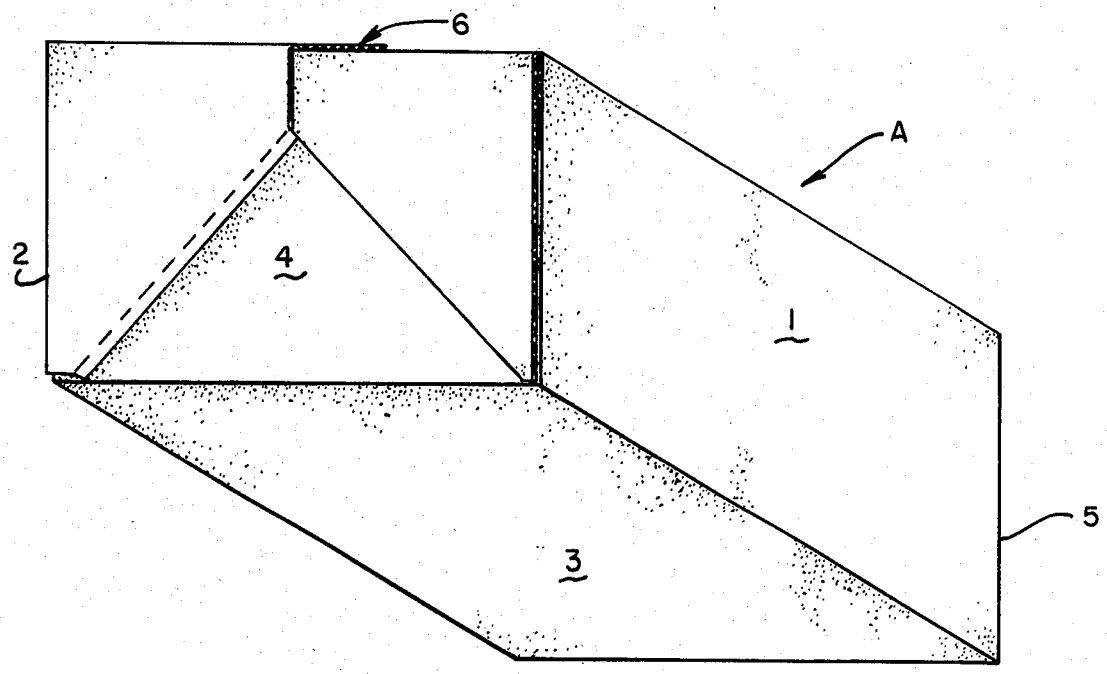
FIG. 1 discloses an isometric view of the fully folded self locking container of this invention.
Figure 2:
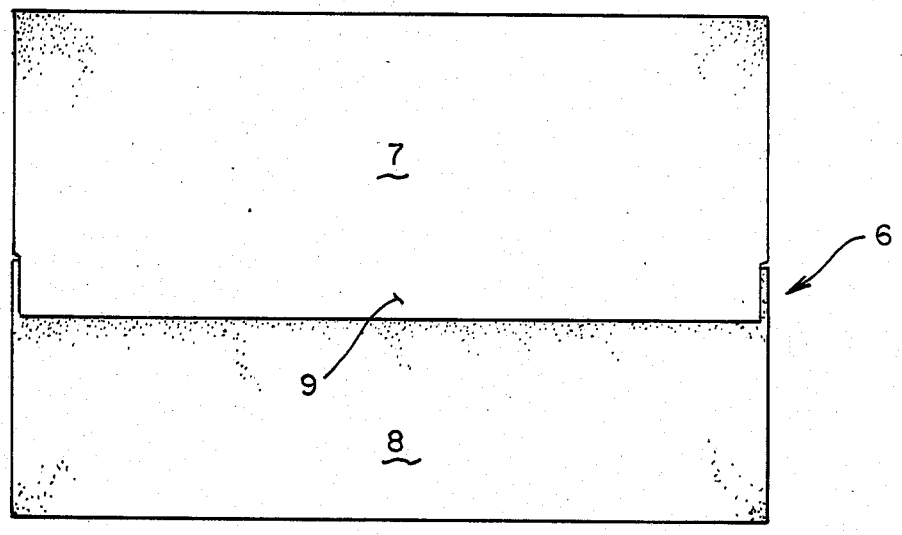
FIG. 2 is a plan view of the container of FIG. 1.
Figure 3:
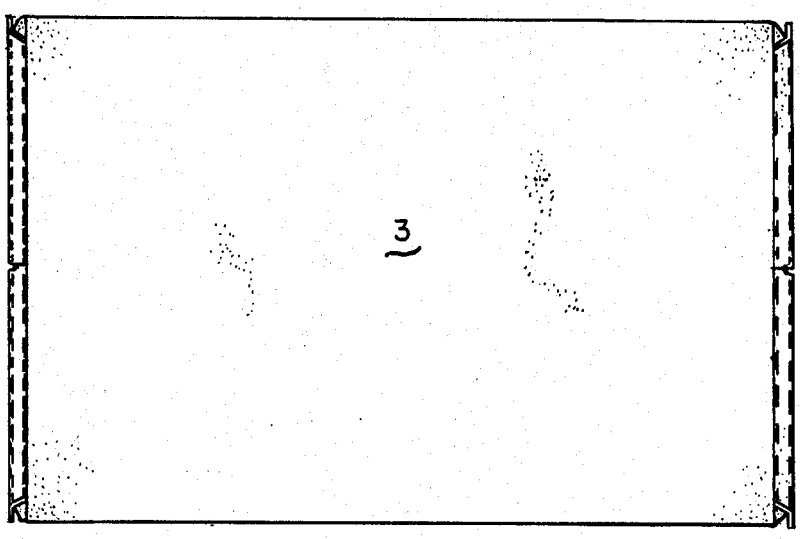
FIG. 3 is a bottom view of the container of FIG. 1.
Figure 4:
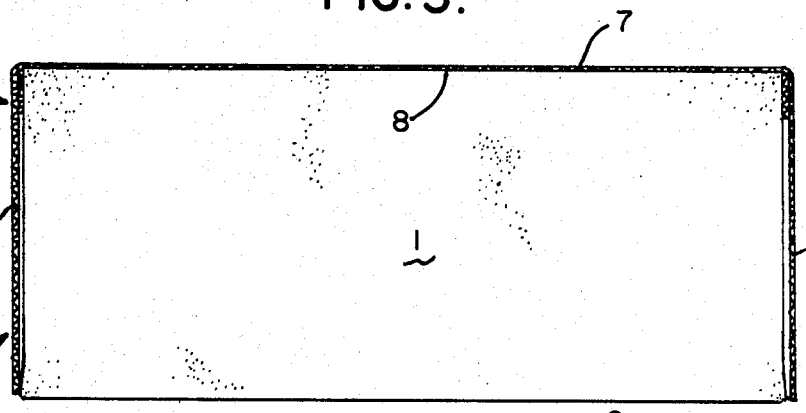
FIG. 4 is a side view of the container of FIG. 1.

In referring to the drawings, and in particular FIG. 1, the self locking container of this invention is fully disclosed, in its folded and usable configuration. The container, identified at A, includes a series of side walls 1 and 2, a bottom wall 3, end walls 4 and 5, and a top wall 6. The top wall 6 may be fabricated as a single panel, as previously explained, and which may be hingedly folded to one of the side walls, but as can be seen in FIG. 2, which is the preferred embodiment as shown herein, it comprises a pair of cover parts 7 and 8, with one of the parts, namely, 7, as shown herein, having a slight overlapping section 9 that does overlie a small central segment of the cover part 8, so as to provide reasonably sealed closure for the container at its upper vicinity.

Figure 8:
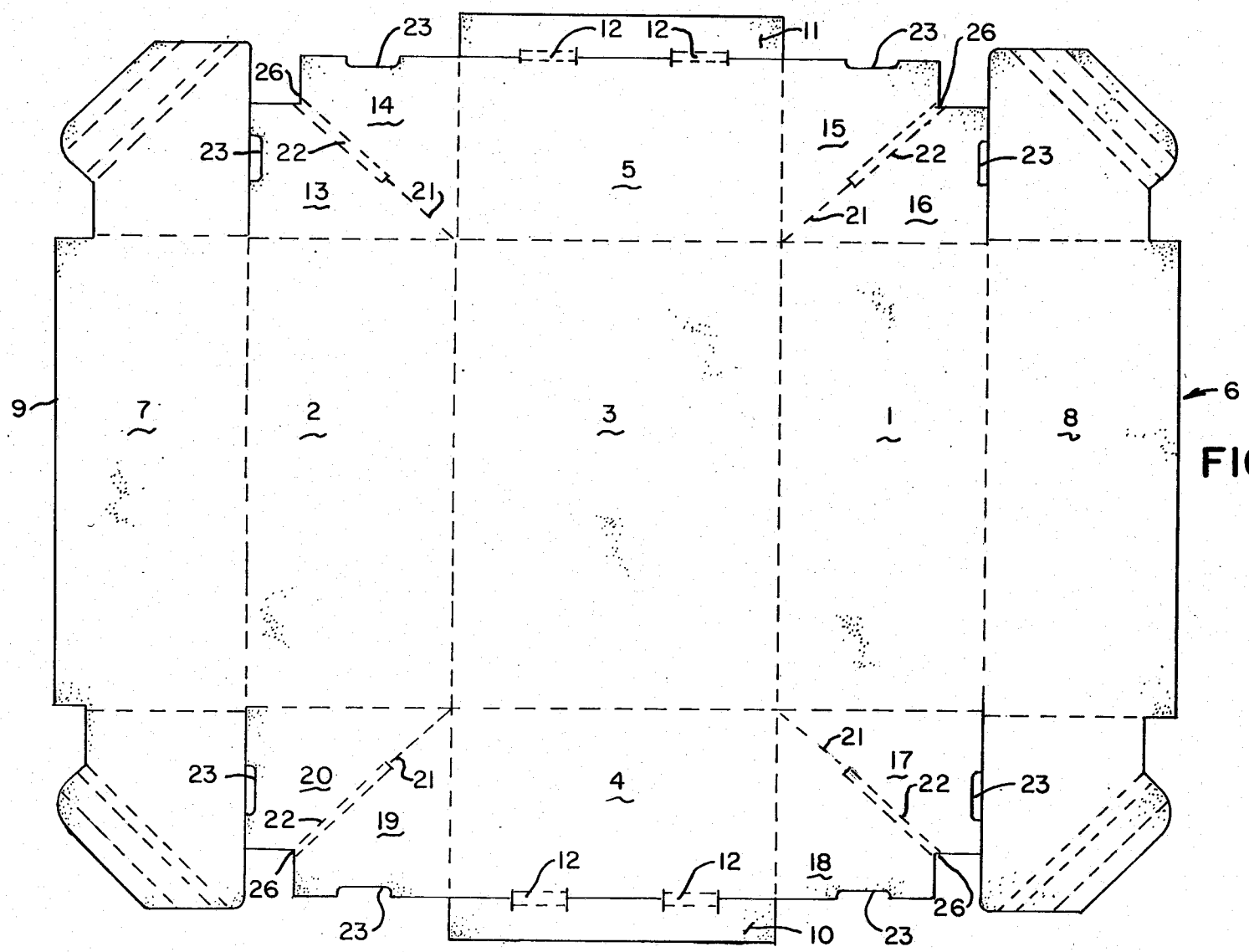
FIG. 8 is a plan view of the entire blank for the style of self locking container disclosed in FIG. 1.

The more specific component structure for this particular self locking container, an integrated container A, is more accurately disclosed in FIG. 8. As can be seen, in the blank form, there are the variety of side walls 1 and 2, the bottom wall 3, the end walls 4 and 5, and the cover 6, formed of the cover parts 7 and 8, with the part 7 having the overlying flap 9 for contiguously resting upon an edge of the cover part 8, as previously explained. As shown and described, all of these various walls and cover parts are foldably and hingedly connected together to provide for their manipulation into particular configurations as the self locking container is folded into its usable form.

The end walls 4 and 5 each possess a connecting flap 10 and 11, respectively, which are hingedly connected to their respective end walls by means of a connecting tab, as shown at 12, and which function to provide for an interlocking of the container together, in a manner as will be subsequently explained.

Figure 7:
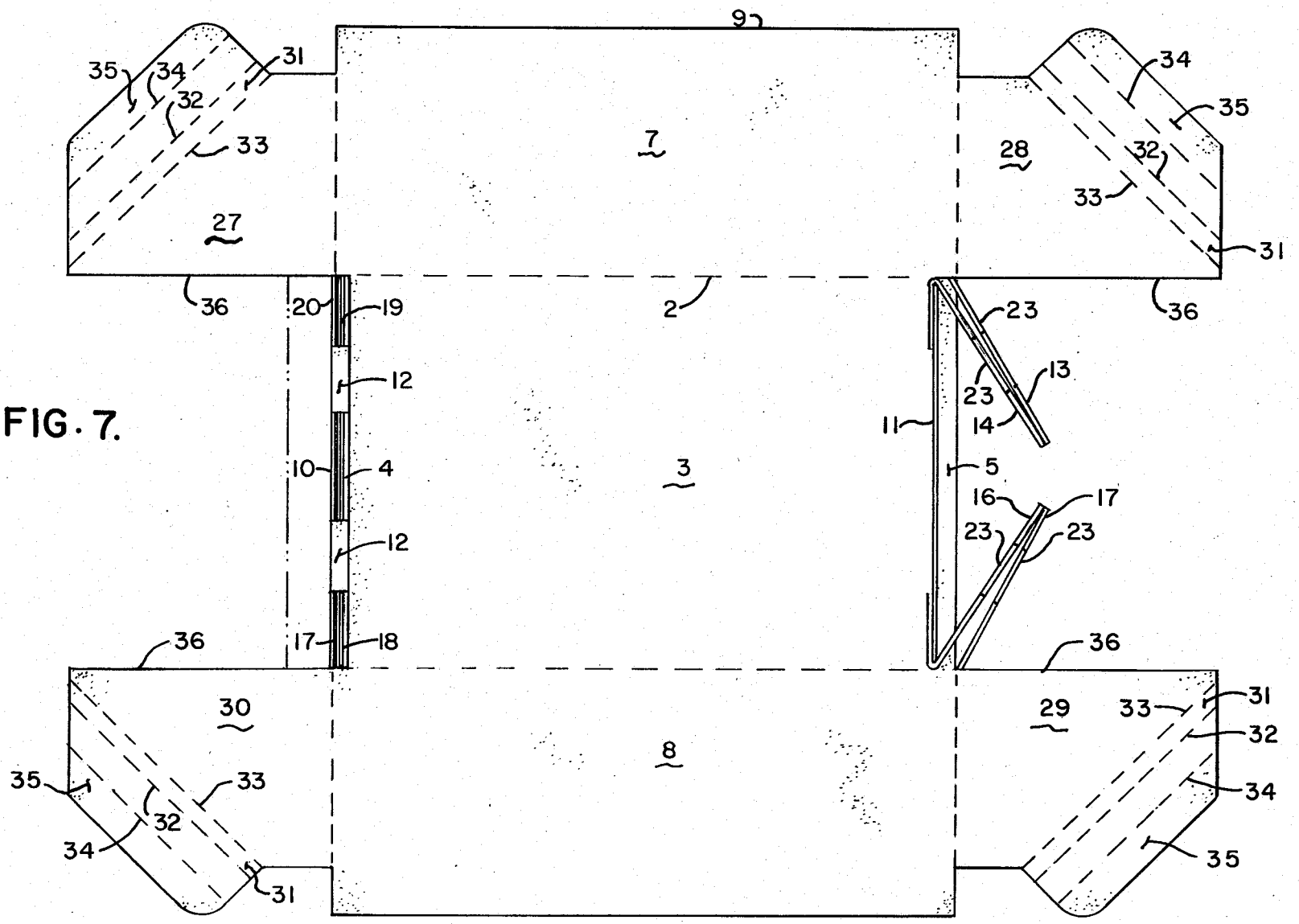
FIG. 7 is a view of the container, in the blank form, showing each cover part fully, in its unfolded form, with a part of the container body portion being folded into closure.

It is also to be noted that there are a series of bellows flaps 13 through 20, and which are either foldably connected together, as along their midlines, as at 21, with additionaly each of the flaps being foldably connected with their adjacent side or end walls, as noted. As the side walls 1 and 2, in addition to the end walls 4 and 5, are folded into their erected configuration, as extending upwardly perpendicularly from the bottom wall 3, each pair of bellows flaps, such as the pair 13 and 14, noted by way of example, fold outwardly and enter into contiguity with each other, providing a rather triangulated flap appearance, with the fold line between these two flaps, as along line 21, widening in its upper segment, as at 22, due to the provision of a double score at this location, so that the fold line provides a substantial width, at that location, for purposes which will be subsequently described. In any event, as can be seen in FIG. 7, as the side walls 1 and 2, are folded perpendicularly with respect to the bottom wall 3, and the end walls 4 and 5 are likewise folded perpendicularly, the bellows flaps 13 through 16, as noted at the end 5, enter into contiguity with their respective flaps, and then may be folded inwardly, as noted in the said FIG. 7, until they become arranged contiguously against the outer surface of the said end panel 5. A similar type of arrangement is undertaken with respect to the bellows flaps and the end wall 4, at the other end of the formed container. As this relationship is achieved, it can be seen that the formed cutouts 23 become disposed facing upwardly along the upper edge of these paired bellows flaps, as can be noted. Then, each end wall 4 and 5 has its respective connecting flap 10 and 11, linked together by means of the tabs 12, and these connecting flaps 10 and 11 respectively fold over the upper disposed edges of the paired bellows flaps 13 and 14, and 15 and 16, as at the end 5 of the container, while a similar type of relationship prevails proximate the end wall 4, at the other end of the formed container, as can be seen. Each connecting flap folds over these upper disposed edges for the bellows flaps, and the tabs 12 become inserted rather snugly within the aligned underlying cutout portions 23 of the said flaps, and in this manner provide for an innerlocking of the container walls together, in addition to a snug adherence of the proximate bellows flaps against the outer surface of the respective end walls 4 and 5. When this relationship of these various walls and flaps is attained, the body portion of the container including all of its various walls and flaps will be integrated together, structurally secured in place by means of the interlocking connection between the connecting flaps 10 and 11 upon their end walls 4 and 5, and their adjacently held bellows flaps 13 through 20 as can be seen.

Figure 6:
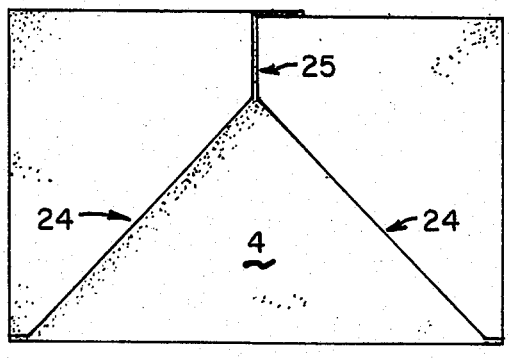
FIG. 6 is an end view of the container of FIG. 1.

In addition, and as can be seen in FIGS. 1 and 6, the underlying bellows flaps, as folded over against their respective end walls 4 and 5, do present angulated edges, generally of the configuration and inclination as indicated at 24, and are of substantial width, at this angulated fold line, due to the double score presented within the intermediate by formed panel between each pair of flaps, as can be noted at 22. The upper segment of each combination bellows flap extends upwardly, as can be generally noted at the configuration shown at 25, and these are achieved as a result of the cutout segments 26 provided at the upper end of each of the paired bellows flaps, as noted.

When the container body or lower portion achieves its folded configuration as noted in FIG. 7, at least with respect to its end wall 4, and while the end wall 5 is in the condition of folding into the same configuration, the cover parts 7 and 8 remain open, being hingedly connected by means of their folds with their respective side walls 2 and 1, as noted. While the cover for the container may be formed as a discrete component, preferably, as in the preferred embodiment, it is integrated into the overall construction of the carton and fabricated in place as when its blank is formed. Each cover part 7 and 8 has extending from an end a series of end flaps 27 through 30, as can be noted, and each end flap incorporates an intermediate panel 31, formed by a pair of score lines 32 and 33, to provide a width for the intermediate panel 31 that is slightly larger than the space provided between the double score lines 22 formed between each pair of bellows flaps. In addition, each end flap 27 through 30 has an additional score or fold line, as at 34, to facilitate the closure of the cover when interlocked with the container body portion, as follows. Once the container body is formed into its folded and usable configuration shown in FIG. 7, the cover parts 7 and 8 are folded over onto closure, as shown in FIG. 2. Their respective end flaps 27 through 30 are folded downwardly, overlying the pairs of bellows flaps, and then their respective flaps 35 are tucked under that angulated lower edge 24 of each of the bellows flaps pairs, as previously explained, with the fold lines 34 facilitating this tuck under manipulation, and the flaps 35 are then pushed upwardly intermediate the paired bellow flaps and the proximate and respective end walls 4 and 5, until such time as the intermediate panels 31 come to rest snugly against the adjacent angulated edges, generally as at 24, disposed proximate each end of the end walls 4 and 5. When securely locked into this condition, the container is fully closed, and these angulated edges, as along the incline 24, as shown in FIG. 6, provides a widened panel, such as the width of that intermediate panel 31, at a location along each end of the formed container, and which are convenient for grasping by the hand to facilitate a lifting and carrying of the ladened container, during its application and usage. Thus, in this manner, as previously explained, there is no need for incorporating any hand openings or hand slots in the end walls 4 and 5, since full structural support is provided due to the proximity and contiguity formed between the various end walls 4 and 5, their contiguous pairs of bellow flaps, as previously noted, in addition to the tucked under portions 35 of the end flanges 27 through 30, that dispose along the inclined edge, as at 24, the various intermediate panels 31, as previously explained.

Figure 5:
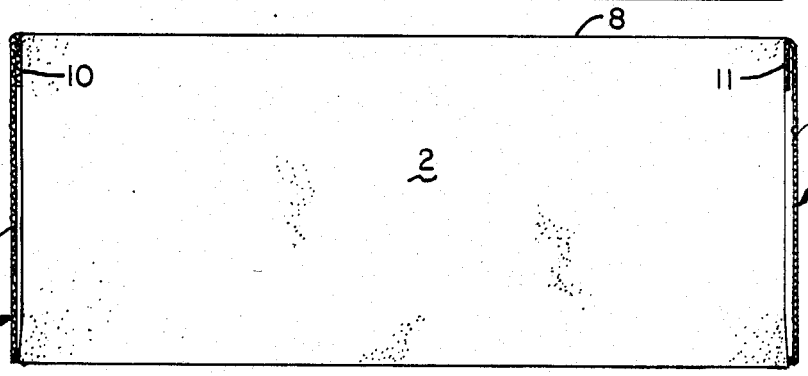
FIG. 5 is an other side view of the container of FIG. 1.

As can be also noted in FIG. 5, when the container is folded into its usable form, the connecting flaps 10 and 11 underlie the end flaps 27 through 30 of the cover parts 7 and 8, as noted. In addition, and in the side view, the edges 36 are disposed along the side edges of the side walls 2 and 3.

In this manner, a fully integrated self locking container is provided, one that can be initially cut as a singluar entity from a sheet of corrugated or other paperboard, at its various fold lines creased or scored therein, and be readily folded into its usable configuration, as explained herein.

Variations or modifications in the structure and assembly of the self locking container of this invention may occur to those skilled in the art upon reviewing the subject matter of this invention. Such variations or modifications, if within the spirit of this invention, are intended to be encompassed within the scope of any claims to patent protection issuing herein. The description of the preferred embodiment set forth in this application, in addition to the depiction of this invention in its drawings, are disclosed for illustrative purposes only.

Having thus described the invention what is claimed and desired to be secured by Letters Patent is:

1. A self-locking container of the type incorporating a pair of side walls, and a pair of end walls, all integrally and foldably connected to a bottom wall to form a container body, a series of bellows flaps at each corner of the folded container body interconnecting intermediately each adjacent side and end wall together, said bellow flaps capable of folding into contiguity and further folding into overlying relationship against the adjacent end wall, a connecting flap foldably connecting along the upper edge of each end wall and disposed for folding over upon the bellows flaps to secure the wall and said bellows flaps into the container body form, each connecting flap incorporating tabs securing each of said flaps to its respective end wall, each series of bellows flaps when folded over ito the container configuration disposing upper edges, each disposed upper edge having at least one cut out portion, and said connecting flap tabs upon each end wall arranged for disposition within said bellows flaps cut out portions to maintain the container body into its folded form, a cover integrally connecting with and provided for the container body, said cover having end flaps, at each end, and disposed for interlocking with the approximate bellows flaps of the container body to secure said self-locking container into closure, said bellows flaps at each corner disposing an angulated edge extending from a lower outer portion of the end wall and inclined upwardly towards a central upper portion of the said end wall, said end flaps of the cover having angled portions aligned with the angulated edges of the bellows flaps, and said angled portions of the end flaps of the cover disposed for tucking under and extending adjacent to the approximate angulated inclined edges of the bellows flaps along substantially the length of and contiguous with the angulated edges of said bellows flaps when securing said container into closure.

2. The invention of claim 1 and wherein said cover foldably connects to at least one side wall.

3. The invention of claim 1 and wherein said cover foldably connects to both side walls.

4. The invention of claim 3 and wherein said cover formed of two parts, and with a part of said cover being foldably connected to a side wall.

5. The invention of claim 4 and wherein one part of the cover overlaps the other part of the cover when the container is folded into closure.

6. The invention of claim 1 wherein there being a fold line provided between each series of bellows flaps provided at each corner interconnecting intermediately each adjacent side and end wall together, said angulated fold line being formed of a double score whereby substantial width is provided for the fold line at said position of fold between a series of bellows flaps.

* * * * *